US010865803B2

(12) United States Patent
Woiczinski

(10) Patent No.: US 10,865,803 B2
(45) Date of Patent: Dec. 15, 2020

(54) IMPELLER WHEEL FOR A CENTRIFUGAL TURBOCOMPRESSOR

(71) Applicant: Siemens Aktiengesellschaft, Munich (DE)

(72) Inventor: Christian Woiczinski, Duisburg (DE)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 170 days.

(21) Appl. No.: 16/075,730

(22) PCT Filed: Jan. 13, 2017

(86) PCT No.: PCT/EP2017/050626
§ 371 (c)(1),
(2) Date: Aug. 6, 2018

(87) PCT Pub. No.: WO2017/137207
PCT Pub. Date: Aug. 17, 2017

(65) Prior Publication Data

US 2019/0032671 A1 Jan. 31, 2019

(30) Foreign Application Priority Data

Feb. 9, 2016 (EP) ..... 16154853

(51) Int. Cl.
*F04D 29/28* (2006.01)
*F04D 29/30* (2006.01)
(Continued)

(52) U.S. Cl.
CPC ..... *F04D 29/284* (2013.01); *F01D 5/048* (2013.01); *F04D 25/045* (2013.01); *F04D 29/30* (2013.01);
(Continued)

(58) Field of Classification Search
CPC ..... F04D 29/284; F04D 25/054; F04D 29/30; F04D 29/444; F01D 5/048; F05D 2250/713
See application file for complete search history.

(56) References Cited

U.S. PATENT DOCUMENTS

2009/0035122 A1* 2/2009 Yagi ..... F04D 29/284 415/1
2018/0073515 A1* 3/2018 Kanzaka ..... F04D 27/02
(Continued)

FOREIGN PATENT DOCUMENTS

DE 102013207220 B3 9/2014
EP 2020509 A2 2/2009
(Continued)

OTHER PUBLICATIONS

International Search Report dated Mar. 31, 2017, for PCT/EP2017/050626.
(Continued)

*Primary Examiner* — Aaron R Eastman

(57) ABSTRACT

An impeller wheel of a turbocompressor, for rotation about an axis, has an inflow cross-section for inflow of a process fluid into the impeller wheel, an outflow cross-section for outflow of the process fluid from the impeller wheel, a wheel disk that defines a hub-side deflection contour from the axial flow direction into the radial flow direction. Blades are applied to the wheel disk, which define flow channels through the impeller wheel, each blade defining a linear inner track and a linear outer track. A meridional angle is defined for each position of a track as the upstream included angle between a meridional plane through the position and a tangent on the track. So that the flow passes through the impeller wheel with improved efficiency, as far as possible
(Continued)

without separation, a local extremum of the meridional angle of the inner track is defined.

11 Claims, 4 Drawing Sheets

(51) Int. Cl.
*F01D 5/04* (2006.01)
*F04D 25/04* (2006.01)
*F04D 29/44* (2006.01)

(52) U.S. Cl.
CPC ..... *F04D 29/444* (2013.01); *F05D 2250/713* (2013.01)

(56) References Cited

U.S. PATENT DOCUMENTS

| | | | | |
|---|---|---|---|---|
| 2018/0142557 | A1* | 5/2018 | Yellapragada | F01D 5/048 |
| 2018/0163731 | A1* | 6/2018 | Matsuda | F04D 29/4213 |
| 2018/0266252 | A1* | 9/2018 | Volpert | F02C 6/12 |
| 2018/0266433 | A1* | 9/2018 | Iurisci | F04D 29/285 |

FOREIGN PATENT DOCUMENTS

| | | | |
|---|---|---|---|
| EP | 2189663 | A2 | 5/2010 |
| JP | H0237297 | U | 3/1990 |
| JP | 2004027894 | A | 1/2004 |

OTHER PUBLICATIONS

EP search report dated Aug. 11, 2016, for EP patent application No. 16154853.2.

* cited by examiner

IMPELLER WHEEL FOR A CENTRIFUGAL TURBOCOMPRESSOR

CROSS REFERENCE TO RELATED APPLICATIONS

This application is the US National Stage of International Application No. PCT/EP2017/050626 filed Jan. 13, 2017, and claims the benefit thereof. The International Application claims the benefit of European Application No. EP16154853 filed Feb. 9, 2016. All of the applications are incorporated by reference herein in their entirety.

FIELD OF INVENTION

The invention relates to an impeller wheel of a turbocompressor, for rotation around an axis, comprising an inlet cross section for the basically axial inflow of a process fluid into the impeller wheel, comprising an exit cross section for the basically radial exit of the process fluid from the impeller wheel, comprising a wheel disk which defines a hub-side deflection contour from the axial flow direction to the radial flow direction, comprising blades, attached on the wheel disk, which define flow passages from a leading edge to a trailing edge in the circumferential direction, at least over a part of the flow path of the process fluid through the impeller wheel, wherein each blade, on an extent end edge which is proximal to the wheel disk, defines a linear inner track extending in the flow direction in such a way that orthogonally equal distances to a blade surface on a pressure side or a suction side of the blade exist on both sides of the inner track, wherein the blade, on an extent end edge which is distal to the wheel disk, defines a linear outer track extending in the flow direction in such a way that orthogonally equal distances to the blade surface on the pressure side and on the suction side of the blade exist on both sides of the outer track, wherein a relative blade length for each position on a track, which is an inner track or outer track, is defined in each case as a proportion of the blade length located downstream of this position in relation to the overall blade length of the subject track, specifically inner track or outer track, wherein a meridional angle for each position of a track is defined as the upstream included angle between a meridional plane through this position and a tangent to the track.

BACKGROUND OF INVENTION

Generic type turbocompressors are already known from DE 10 2013 207 220 B3. This type of turbocompressor is also referred to as a centrifugal compressor because the delivered process fluid is accelerated radially outward in the impeller wheel as a result of centrifugal forces. In principle, mechanical energy is added to the gas or to the process fluid for the purpose of compression by means of a rotating blade arrangement of the impeller wheel. The inducted process fluid is decelerated inside the flow passages of the impeller wheel, which are formed between the individual blades, relative to the movement of the impeller wheel and therefore is compressed to a higher pressure level in accordance with the physical laws of fluid mechanics. Since the impeller wheel moves at high rotational speed, the fluid, after flowing out of the impeller wheel in a radial direction, is further decelerated in an adjoining diffuser and in this way is additionally compressed in accordance with Bernoulli's laws.

In such fluid energy machines, unavoidable fluid mechanical losses always occur. The reduction of these losses is an optimization problem, in the processing of which attention is paid to the fact that in particular no separations of the flow from the blade or other impeller wheel surfaces occur. The result of this optimization task is described as a rule in relation to the blade in a so-called angle distribution and thickness distribution over the running length of the blade on the wheel disk and shroud disk. These two-dimensional profiles on the wheel disk and shroud disk are geometrically connected, for example by means of straight lines which are also referred to as "regular straight lines". The three-dimensional figure which is obtained as a result can be produced in a flank milling process. In order to avoid such a design cost for each only slightly different compression task having to be completely worked off, such a blade is geometrically initially designed to be larger than is usually used. This 3-dimensional figure—extending beyond the limits of leading edge, trailing edge, wheel disk and shroud disk—consisting of a pressure side and a suction side, is referred to as a definition area. This definition area of the blade, which is described by means of the angle distribution on the wheel disk and the shroud disk and the blade thickness distribution, is used for the purpose of order processing. Sub-areas—depending on wheel disk geometries and shroud disk geometries—are extracted from this definition area within defined limits and used in an individual impeller wheel design.

Geometric designations, such as axial, radial, tangential or circumferential direction are always in relation to a rotation axis of the impeller wheel, providing reference to the contrary is not specified.

SUMMARY OF INVENTION

The invention has set itself the task of developing an impeller wheel for a turbocompressor in such a way that the efficiency is improved compared with conventional impeller wheels for the same intended purpose.

For achieving the object according to the invention, it is proposed that in the region of between 10% and 90% of the relative blade length a local extremum of the meridional angle of the inner track exists.

It has been shown that the advantageous geometry of the blades of an impeller wheel identified by the invention leads to a particularly good level of efficiency, because in particular an only slight separation of the process fluid from the impeller wheel surfaces takes place during operation in comparison to conventional geometries.

The definition of relative blade lengths selected by the invention enables the correlation of positions of the inner track and the outer track with regard to the respective comparative distances or proximity to the leading edge and trailing edge.

In principle, the invention offers an advantageous geometry of impeller wheels both for so-called closed impeller wheels (impeller wheels with a shroud disk) and for so-called open impeller wheels which do not have a shroud disk. An embodiment of the invention are impeller wheels with a shroud disk which defines the flow passages, adjacent to the extent end edges, and is attached on the blades in the region of the extent end edges of the blades. The embodiments which are rendered here for closed impeller wheels and partially relate to a shroud disk also apply to open impeller wheels which do not have a shroud disk. The linear inner track extends in this case along an extent end edge of the blades, which is distal from the wheel disk, between the leading edge and the trailing edge. The open flow passages of the open impeller wheel adjoin a stator contour during operation, closing the openings which are distal to the wheel disk, so that the fluidic boundary conditions for the requirements of the invention are similar.

The geometry according to the invention becomes particularly advantageous if the variation of the meridional angle is monotonically decreasing between 10% and 90% of the relative blade length of the outer track. The findings of the invention indicate that the efficiency of the impeller wheel can be increased if, in contrast to the inner track, the outer track has no local extremum in the angle variation along the relative blade length.

An advantageous development of the invention provides that in the region of between 10% and 90% of the relative blade lengths the maximum difference of the meridional angle between the inner track and the outer track for a defined position along the relative blade lengths is between 10° and 25°. In this case, it is the particular knowledge of the invention that the meridional angle distribution on the inner track and the outer track differs significantly. By the maximum difference, the highest possible difference is not meant in this connection, but the highest actually occurring difference. The invention therefore provides in this advantageous development that an actual maximum difference occurs between the inner track which is between 10° and 25°. The fluidic efficiency is particularly advantageous if the location of the maximum difference between inner track and outer track lies in the region of between 15% and 45% of the relative blade length.

Another advantageous development of the invention provides that the trailing edge of the blades is not inclined in each case in relation to a meridional plane. It is correspondingly proposed that the trailing edge of the blade includes an angle of between 0° and 5° with a meridional plane. The set requirement that the trailing edge of the blade lies in a meridional plane is also referred to in professional circles as rake=0.

An advantageous development of the invention provides that the blade leading edge forms an angle of between 35° and 45°, advantageously 41°, with a radial plane. The leading edge of the blade is correspondingly slightly set back in relation to the inflow into the impeller.

A particularly advantageous development of the invention provides that in the region of between 10% and 90% of the relative blade length the variation of the meridional angle of the inner track has a turning point between 40% and 80% of the relative blade length. The geometry which is seen to be advantageous in this way contributes to the further efficiency improvement of the fluid mechanics on the blade of the impeller wheel according to the invention.

It has been shown that in the region of between 10% and 90% of the relative blade length the variation of a blade thickness distribution of the inner track in the flow direction should advantageously be designed to be monotonically increasing. In a further advantageous development, the blade thickness distribution on the outer track can be selected to be basically constant.

In the following text, several advantageous embodiments of the invention are listed (1.-8.), which embodiments, individually or optionally combined with each other in a practical manner by a person skilled in the art, improve the outcome of the invention:

Another advantageous development of the invention provides that the meridional angle of the outer track changes by less than 5% in the definition range of between −20% (still outside the actual blade) to +20%. This means in other words that the curvature of the outer track is almost constant in this range.

Another advantageous development of the invention provides that the angle variation of the outer track indicates no distinct local extremum. The term "local extremum" means in this case an extremum in the mathematical sense (that is to say the 1. differentiation of the angle distribution being zero corresponds here to the term "local extremum"). The meridional angle can advantageously be maximum at the blade leading edge.

Another advantageous development of the invention provides that a "local extremum" (means here an extremum in the mathematical sense (that is to say the 1. differentiation of the angle distribution being zero corresponds here to the term "local extremum")) occurs in the region of the blade trailing edge (95%-100% of the relative blade length), advantageously directly at the blade trailing edge, so that the angle variation is zero.

Another advantageous development of the invention provides that the range of the largest angle variation of the outer track lies between −20% and +20%. Preferably, the angle variation is reversed or reduced downstream. In this way, load is removed from the shroud disk flow so that subsequently flow separations are avoided.

Another advantageous development of the invention provides that after approximately 70% of the meridional extent of the outer track the angle changes only by less than 5%, advantageously by less than 3%.

Another advantageous development of the invention provides that a leading edge which in meridional section is inclined forward, with advantageously a 41° inclination, ensures that the meridional extents of the inner and outer tracks no longer differ from each other to such a great extent. As a result of this, the flow on the wheel disk and shroud disk is loaded more evenly.

Another advantageous development of the invention provides that the meridional angle of the outer track, apart from the identical angle at the blade trailing edge, is constantly larger than that of the inner track.

Another advantageous development of the invention provides that a particular maximum angle difference between inner track and outer track of 10°-25° exists in the range of a meridional extent of 15% to 45%, advantageously between 25%-35%.

BRIEF DESCRIPTION OF THE DRAWINGS

In the following text, the invention is explained in more detail based on a specific exemplary embodiment with reference to drawings and graphs. In the drawing.

DETAILED DESCRIPTION OF INVENTION

Figure 1:
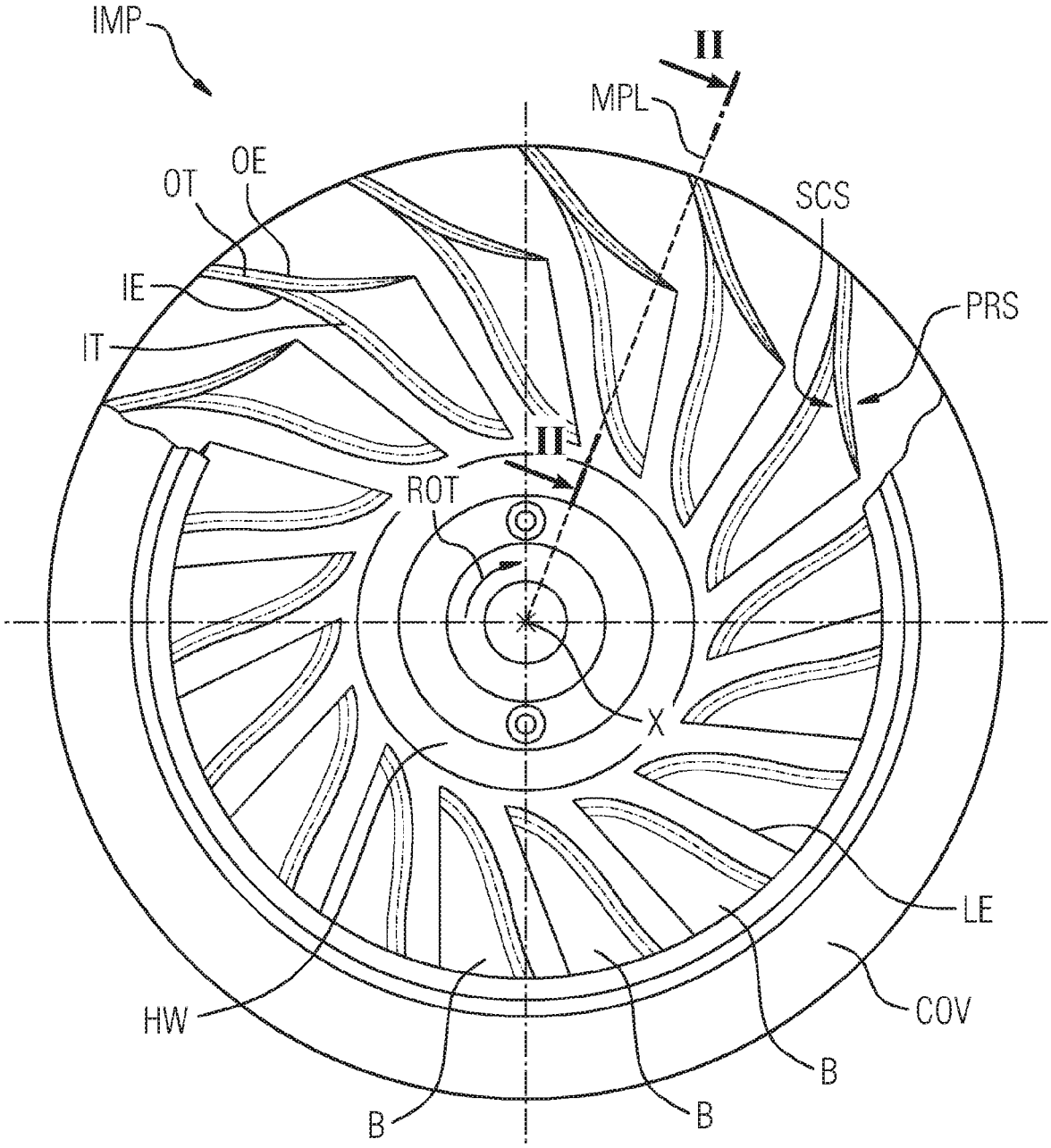
FIG. 1 shows a view of an impeller wheel according to the invention, with a partially sectioned shroud disk, in the axial direction.
Figure 2:
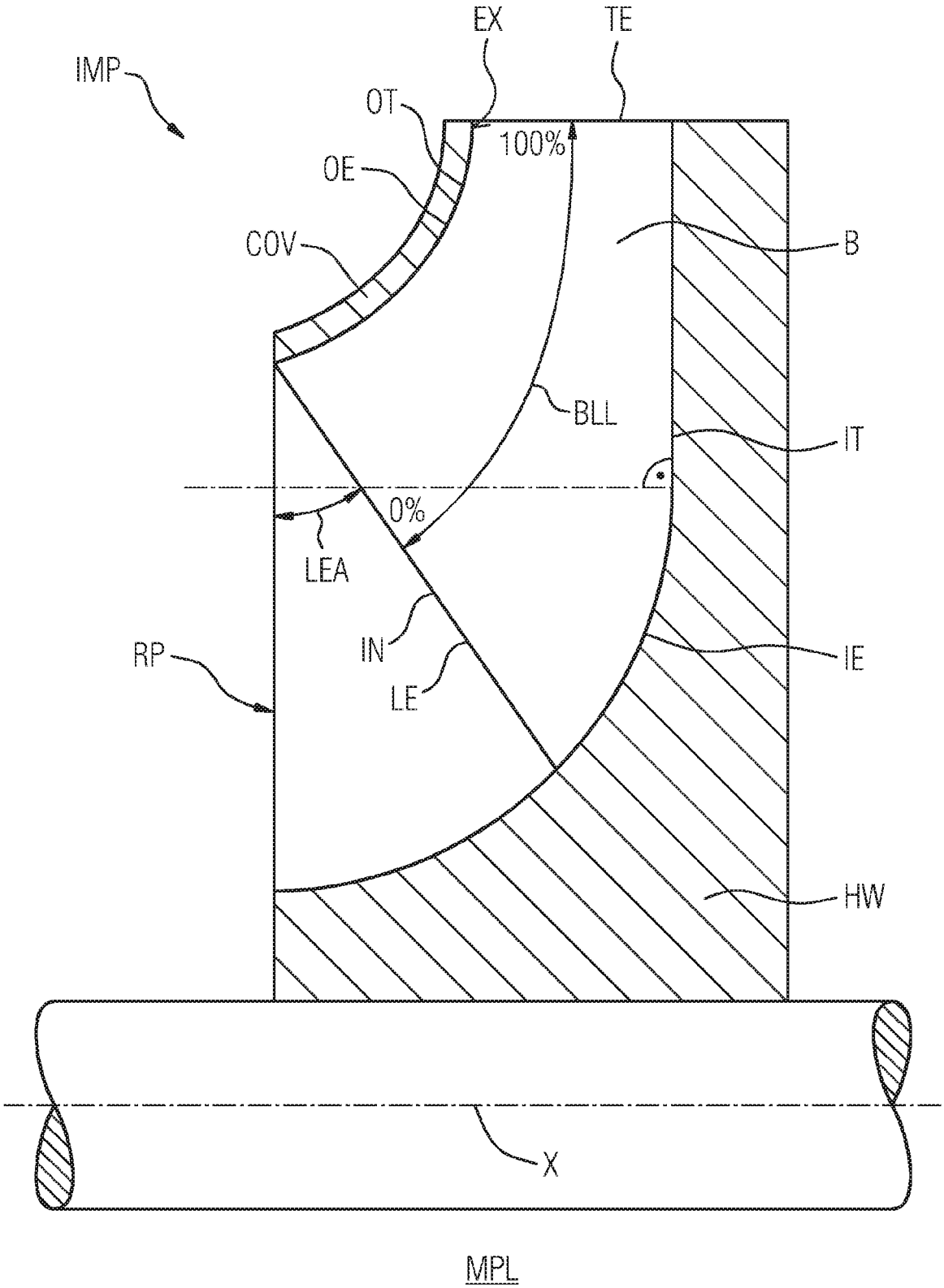
FIG. 2 shows a meridional section along the rotation axis through a schematic view of an impeller wheel according to the section II-II in FIG. 1.

FIG. 1 shows an axial plan view of an impeller wheel IMP according to the invention, comprising a shroud disk COV, blades B and a wheel disk HW. Indicated in the middle of the wheel disk HW is the rotation axis X around which the impeller wheel rotates along a rotation direction ROT during operation. Schematically indicated in a radial direction is a meridional section II-II along a meridional plane MPL, which is reproduced in FIG. 2. The individual blades B have in each case a pressure side PRS and a suction side SCS. In the axial plan view shown in FIG. 1, the leading edge LE of the blade B is made apparent to the viewer. Where the shroud disk COV is cut away in FIG. 1, an outer track OT is reproduced by a dash-dot line on the outer extent end edge OE of the blade B. An inner track IT, also represented by a dash-dot line, is shown directly on the wheel disk HW on the inner extent end edge IE which is proximal to the wheel disk HW. These facts can also relate to FIG. 2. Each blade B, on an extent end edge IE which is proximal to the wheel disk HW, has a linear inner track IT extending in the flow direction in such a way that orthogonally equal distances to a blade surface on the pressure side PRS or the suction side SCS of the blade B exist on both sides of the inner track. Each blade B, on an extent end edge OE which is distal to the wheel disk HW, has a linear outer track extending in the flow direction in such a way that orthogonally equal distances to the blade surface on the pressure side PRS and the suction side SCS exist on both sides of the outer track.

These corresponding inner tracks and outer tracks on the blades can also be defined in such a way that these tracks are in each case the sum of the middle points of circles inscribed in the blade profiles.

Figure 3:
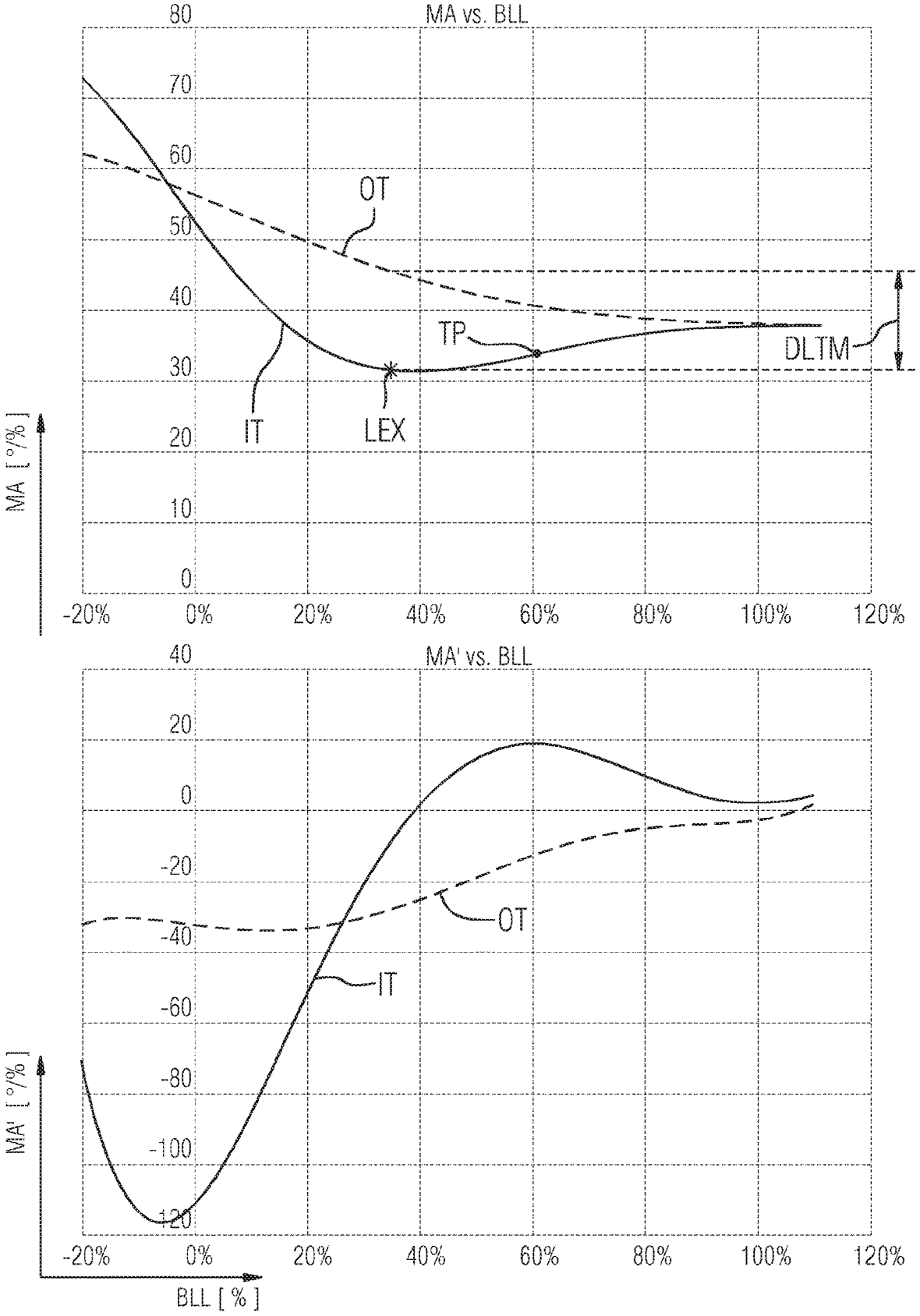
FIG. 3 shows in a synoptic representation a meridional angle distribution along the relative blade length and also the variation of the meridional angle along the relative blade length.

FIG. 3 shows in each case as a function of the relative blade length BLL in the upper graph area the variation of the meridional angle for the inner tack IT and the outer track OT, and in the lower graph area shows the differentiation of the meridional angle MA' according to the relative blade length BLL for the inner track IT and the outer track OT.

The blade leading edge LE in this case forms an angle LEA of 41° with a radial plane RP. The leading edge of the blade B is correspondingly located in a slightly set back manner.

Figure 4:
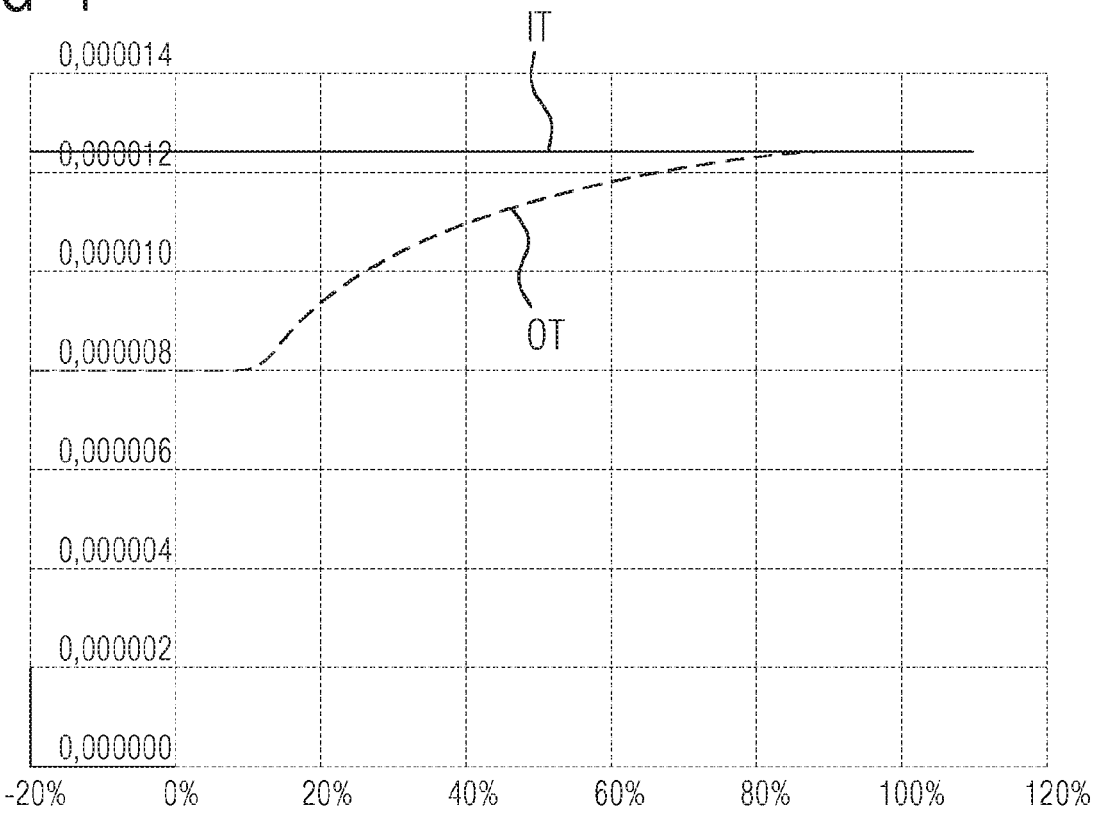
FIG. 4 shows a blade thickness distribution along the relative blade length.

The graph of FIG. 4 shows the blade thickness distribution as a variation over the relative blade length BLL for the inner track IT and the outer track OT.

Figure 5:
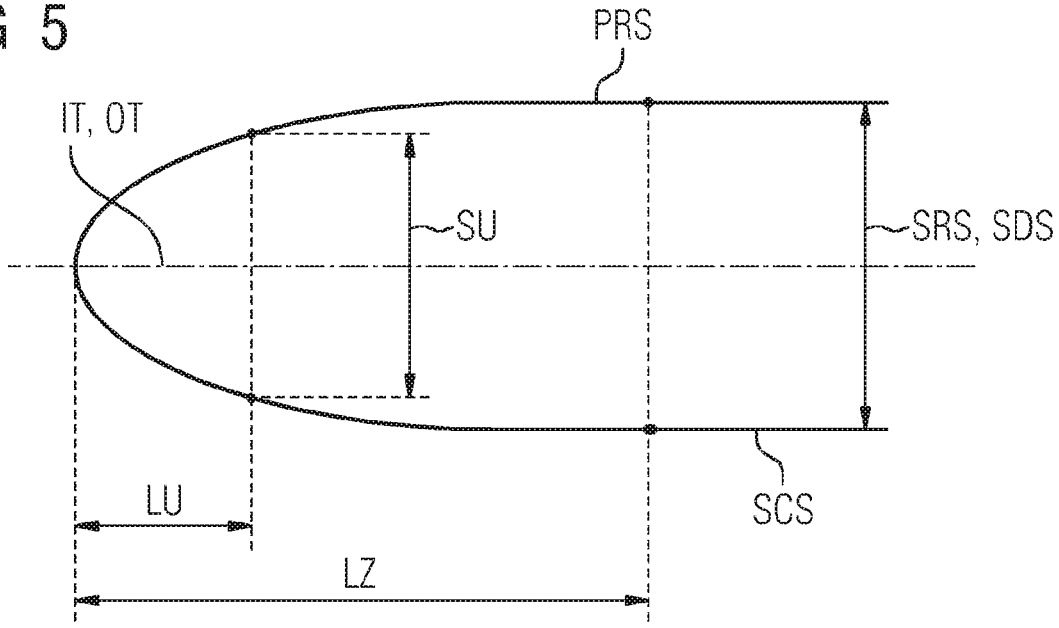
FIG. 5 shows a detailed view of a leading edge as a schematic circumferential tangential section of a radial view.

In this case, consideration is to be given to the fact that deviating from this variation a beveling of the leading edges and trailing edges of the blades is designed. By way of example, FIG. 5 shows details of such a beveling on a leading edge of a wheel disk or shroud disk in a schematic circumferential tangential section from the radial view. The example shown there is dimensioned thus:

| Parameter | Wheel disk | Shroud disk |
|---|---|---|
| SDS | | 2.42 mm |
| SRS | 3.73 mm | |
| LZ | 11.2 mm | 12.0 mm |
| LU | 4.7 mm | 2.5 mm |
| SU | 3.1 mm | 1.8 mm |

The meanings here being:

SDS: Blade thickness of shroud disk COV

SRS: Blade thickness of wheel disk HW

LZ: Length of the beveling

LU: Transition thickness

SU: Transition length

These parameters can be scaled so that an application to other blade thicknesses is possible.

The graphs of FIGS. 3 and 4 show in each case a variation which is extended on both sides beyond the 0% and 100% positions of the relative blade length BLL. In this case, it is a definition area which in the specific impeller wheel is delimited in each case by the inner and outer extent end edge OE, IE, the leading edge LE and the trailing edge TE of the blade B. The findings according to the invention concerning the distribution of the meridional angle MA for a blade B also apply in conjunction with the blade thickness distribution to the inner track IT and the outer track OT basically independently of the detail from this definition area providing certain limits are not exceeded. Within limits, an extrapolation of this area can also be carried out. The description of the blades B by means of the distribution of the meridional angle MA and the thickness distribution over the extent of the blades B in the flow direction or over the relative blade length BLL leads, in the case of a connection by means of straight lines of the blade profiles spanned by the inner track and the outer track by means of the thickness distribution, to a three-dimensional surface in space which can be produced by means of a flank milling process. In principle, the three-dimensional blade which is spanned by means of so-called regular straight lines between the outer and inner blade profiles is advantageous, wherein in principle a different geometry than a straight line is also conceivable according to the invention, for example a curve, which is defined by means of a polygon or splines and support points.

So that this so-defined general area, which is also referred to as the definition area or as the maximal area, can be used for different compression tasks or impeller wheels IMP, sub-areas are extracted by means of meridional sections from this definition area for the purpose of being used in an impeller wheel design. The definition area according to the invention is suitable in this respect for a field of application of the specific throughflow $\Psi=V/u*d_2^2$ between 0.05 and 0.16, wherein the meanings are:

V: Volumetric flow in cubic meters per second

U: Circumferential speed in meters per second $d_2$: Impeller wheel diameter in meters The embodiment according to the invention of the blade B of an impeller IMP provides according to FIG. 3 that between approximately 10% and 60% of the relative blade length BLL a local extremum LEX of the meridional angle MA of the inner track IT exists. This local extremum LEX advantageously lies between 25% and 45% of the relative blade length BLL. Especially advantageously—as shown in FIG. 3, first graph—the variation of the meridional angle MA for the outer track OT is monotonically decreasing between 10% and 90% of the relative blade length. Also especially advantageously, between the inner track IT and the outer track OT there is a difference in the meridional angle MA which increases to a maximum difference DLTM along the relative blade length, wherein this actually existing maximum difference is between 10° and 25°. Especially advantageously, this maximum difference DLTM occurs in the region of between 15% and 45% of the relative blade length BLL. Especially advantageously, the inner track IT and the outer track OT in the region of the trailing edge TE—that is to say at 100% of the relative blade length BLL—have the same meridional angle MA. It follows from this that the middle extent of the trailing edge TE of the blade B includes an angle with a meridional plane MPL of approximately 0° or is parallel to this meridional plane MPL. This angle deviation in relation to the meridional plane MPL of the trailing edge TE should advantageously be less than 5°. A further especially advantageous embodiment of the invention, depicted in the exemplary embodiment, provides that in the region of between 40% and 80% of the relative blade length BLL the variation of the meridional angle MA of the inner track IT has a turning point TP.

The invention claimed is:

1. An impeller wheel of a turbocompressor, for rotation around an axis, comprising:

an inlet cross section for the axial inflow of a process fluid into the impeller wheel, an exit cross section for the radial exit of the process fluid from the impeller wheel, a wheel disk which defines a hub-side deflection contour from the axial flow direction to the radial flow direction, blades, attached on the wheel disk, which define flow passages from a leading edge to a trailing edge in the circumferential direction, at least over a part of the flow path of the process fluid through the impeller wheel, wherein the blade leading edge forms an angle of between 35° and 45°, with a radial plane, wherein each blade, on an extent end edge which is proximal to the wheel disk, defines a linear inner track extending in the flow direction in such a way that orthogonally equal distances to a blade surface on a pressure side and a suction side of the blade exist on both sides of the inner track, wherein the blade, on an extent end edge which is distal to the wheel disk, defines a linear outer track extending in the flow direction in such a way that orthogonally equal distances to a blade surface on the pressure side and the suction side of the blade exist on both sides of the outer track, wherein a relative blade length for each position on a track, which is an inner track or outer track, is defined in each case as a proportion of the blade lengths located upstream of this position to the overall blade length of the subject track, specifically inner track or outer track, wherein a meridional angle for each position of a track is defined as the upstream included angle between a meridional plane through this position and a tangent to the track, wherein in the region of between 10% and 90% of the relative blade length a local extremum of the meridional angle of the inner track exists.

2. The impeller wheel as claimed in claim 1, wherein the local extremum of the variation of the meridional angle of the inner track lies between 25% and 45% of the relative blade length.

3. The impeller wheel as claimed in claim 1, wherein the impeller wheel has a shroud disk which defines the flow passages, adjacent to the extent end edge, and is attached on the blades in the region of the extent end edge.

4. The impeller wheel as claimed in claim 1, wherein in the region of between 10% and 90% of the relative blade lengths the maximum difference of the meridional angle between the inner track and the outer track for a defined position along the relative blade lengths is between 10° and 25°.

5. The impeller wheel as claimed in claim 4, wherein the maximum difference of the meridional angle between the inner track and the outer track along the relative blade lengths lies in the region of between 15% and 45% of the relative blade lengths.

6. The impeller wheel as claimed in claim 1, wherein a middle extent of the trailing edge of the blade includes an angle with a meridional plane of between 0° and 5°.

7. The impeller wheel as claimed in claim 6, wherein the middle extent of the trailing edge of the blade includes an angle with a meridional plane of 0°.

8. The impeller wheel as claimed in claim 1, wherein in the region of between 10% and 90% of the relative blade lengths the variation of the meridional angle of the inner track has a turning point between 40% and 80% of the relative blade length.

9. The impeller wheel as claimed in claim 1, wherein in the region of between 10% and 90% of the relative blade lengths the variation of a blade thickness distribution of the inner track is monotonically increasing in the flow direction.

10. The impeller wheel as claimed in claim 1, wherein the variation of the meridional angle of the outer track is monotonically decreasing between 10% and 90% of the relative blade length.

11. The impeller wheel as claimed in claim 1, wherein the blade leading edge forms an angle of 41° with the radial plane.

* * * * *